US009523333B2

(12) United States Patent
Bolz et al.

(10) Patent No.: US 9,523,333 B2
(45) Date of Patent: Dec. 20, 2016

(54) ACTUATOR UNIT, IN PARTICULAR FOR INJECTING A FUEL INTO A COMBUSTION CHAMBER OF AN INTERNAL COMBUSTION ENGINE

(71) Applicant: Continental Automotive GmbH, Hannover (DE)

(72) Inventors: Stephan Bolz, Pfatter (DE); Martin Goetzenberger, Ingolstadt (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 505 days.

(21) Appl. No.: 14/049,415

(22) Filed: Oct. 9, 2013

(65) Prior Publication Data

US 2014/0096746 A1 Apr. 10, 2014

(51) Int. Cl.
*F02M 51/06* (2006.01)
*F02D 41/20* (2006.01)

(52) U.S. Cl.
CPC ..... *F02M 51/06* (2013.01); *F02M 51/0664* (2013.01); *F02D 41/20* (2013.01); *F02D 2041/2058* (2013.01)

(58) Field of Classification Search
CPC ..... F02M 51/0603; F02M 51/061; F02M 51/0614; F02M 51/0617; F02M 51/0621; F02M 51/0628; F02M 51/0625; F02M 51/0635; F02M 51/0639; F02M 51/0642; F02M 51/0664; F02M 51/0689; F02M 51/0696; F02M 51/0692; F16K 31/02; F16K 31/047; F16K 31/06; F16K 31/0606; F16K 31/0613; F16K 31/0648; F16K 31/0651; F16K 31/0655; F16K 31/0658; F16K 31/0675; F16K 31/0679; F16K 31/082; F16K 31/08; F16K 31/084; F16K 31/086
USPC ..... 123/472, 474, 475, 476, 477, 478, 479,123/482, 483, 484, 485, 488, 490, 491, 492,123/494, 467, 297, 568.21; 74/473.12, 574.1; 137/831, 166, 487.5, 601.14; 251/129.15, 251/129.16, 159; 335/55, 80, 95, 119, 124, 514, 335/180, 184, 187, 203, 220, 232, 233, 235, 335/236, 249, 251, 270, 271, 273, 278, 279, 335/237, 281; 239/585.1, 585.4, 585.5; 310/14, 310/23, 24, 25, 30, 34, 12.25, 12.26, 12.21
See application file for complete search history.

(56) References Cited

U.S. PATENT DOCUMENTS 4,046,351 A * 9/1977 Lang ..... F16K 31/0658 251/129.17
4,242,606 A * 12/1980 Nonnenmann ..... H01F 7/1607 310/12.01
4,550,302 A * 10/1985 Watanabe ..... H01F 7/1615 335/228
(Continued)

*Primary Examiner* — Hung Q Nguyen
*Assistant Examiner* — John Bailey
(74) *Attorney, Agent, or Firm* — Slayden Grubert Beard PLLC

(57) ABSTRACT

An actuator unit for injecting fuel into a combustion chamber of an internal combustion engine includes an electrically conductive excitation winding, a ferromagnetic circuit having a ferromagnetic return, and a moveable armature. The armature is held in an idle position by a holding force of a spring element. A current flowing through the excitation winding produces (a) a magnetic holding force acting on the armature in the same direction as the spring holding force provided by the spring element, and (b) a magnetic motive force acting on the armature in the opposite direction as the magnetic holding force and spring holding force. The armature can be moved to a working position in which the armature adjoins the ferromagnetic return by increasing the current through the excitation winding above a predeter-
(Continued)

mined value that results in the magnetic motive force exceeding the magnetic holding force combined with the spring holding force.

12 Claims, 6 Drawing Sheets

(56) References Cited

U.S. PATENT DOCUMENTS 4,631,430 A * 12/1986 Aubrecht ..... H01F 7/1615 310/12.24
4,984,549 A * 1/1991 Mesenich ..... F02M 51/0625 123/472
RE34,870 E * 3/1995 Cummins ..... H01F 7/13 310/12.01
5,422,617 A * 6/1995 Brown ..... H01F 7/1607 335/264
5,779,220 A * 7/1998 Nehl ..... F02M 26/53 123/568.26
6,651,951 B2 * 11/2003 Krimmer ..... F02M 25/0836 123/568.21
6,819,209 B2 * 11/2004 Yajima ..... F16F 15/03 335/257
6,929,242 B2 * 8/2005 Kirsch ..... F16K 31/0613 251/129.15
6,948,697 B2 * 9/2005 Herbert ..... F16K 31/0672 251/129.04
7,021,568 B2 * 4/2006 Rieger ..... F01L 9/04 239/533.2
7,688,169 B2 * 3/2010 Zhao ..... H01F 7/1607 310/12.01
8,027,778 B2 * 9/2011 Winstead ..... F02D 13/0253 701/105
8,272,622 B2 * 9/2012 Caldwell ..... F02M 51/0635 251/129.01
8,432,242 B2 * 4/2013 Irwin ..... H01F 7/1615 335/255
8,505,514 B2 * 8/2013 Fang ..... F02M 45/12 123/445
2003/0140898 A1 * 7/2003 Xu ..... F02D 41/20 123/490
2005/0045146 A1 * 3/2005 McKay ..... F02M 51/0671 123/297
2006/0278199 A1 * 12/2006 Yamamoto ..... F02M 57/025 123/467
2008/0092854 A1 * 4/2008 Grundl ..... F02M 45/08 123/476
2010/0006679 A1 * 1/2010 Manubolu ..... F02M 47/027 239/585.5
2010/0007224 A1 * 1/2010 Manubolu ..... F02M 47/027 310/14
2010/0043758 A1 * 2/2010 Caley ..... F02M 21/0254 123/490
2011/0062363 A1 * 3/2011 Weiss ..... H01F 7/088 251/129.15
2011/0121218 A1 * 5/2011 Hoppe ..... H01F 7/081 251/129.15
2012/0175974 A1 * 7/2012 Robertson ..... H01F 7/1646 310/12.26
2013/0333773 A1 * 12/2013 Holmes ..... F16K 31/0613 137/487.5
2014/0203113 A1 * 7/2014 Venkataraghavan F02M 47/027 239/585.5
2015/0041568 A1 * 2/2015 Izzo ..... F02M 51/0685 239/585.5
2015/0260138 A1 * 9/2015 Filippi ..... F02M 51/0671 239/585.5

* cited by examiner

ACTUATOR UNIT, IN PARTICULAR FOR INJECTING A FUEL INTO A COMBUSTION CHAMBER OF AN INTERNAL COMBUSTION ENGINE

CROSS-REFERENCE TO RELATED APPLICATIONS

This application claims priority to DE Patent Application No. 2012 218 325.6 filed Oct. 9, 2012. The contents of which is incorporated herein by reference in its entirety.

TECHNICAL FIELD

This disclosure relates to an actuator unit, in particular for injecting a fuel into a combustion chamber of an internal combustion engine. This unit comprises an electrically conductive excitation winding, a ferromagnetic circuit having a ferromagnetic return and an armature, which can be moved along an axis. The armature is held in an idle position by a holding force of a spring element, whereby the armature is spaced apart from the ferromagnetic return by an air gap. The armature is in a working position in which the armature adjoins the ferromagnetic return when a maximum coil current is flowing through the excitation winding and the winding is producing a magnetic motive force.

BACKGROUND

Actuator units for injecting fuel are very frequently used as solenoid actuators, e.g. in automotive engineering. Examples are, for instance, the actuation of fuel injection valves or control of the adjustment of cam pieces for inlet and outlet valves of engines.

As illustrated schematically in FIG. 1, a solenoid actuator comprises an electrically conductive excitation winding 10, a ferromagnetic circuit 20 having a moving armature 30, and a ferromagnetic return. In the unactivated state of the actuator, there is an air gap 21 between the armature 30 and the ferromagnetic return, and said gap can amount to between 50 μm and about 1 mm, depending on application. By way of example, the armature 30 is connected to a nozzle needle 31 or the like. In general, the armature 30 is held in an idle position by means of a return spring 15, in which case the air gap 21 is open.

When a voltage is applied to the excitation winding 10, a magnetic fields builds up as the current flow increases in the ferromagnetic circuit 20. This field gives rise to a force which tends to reduce the air gap 21. As long as the magnetic force is smaller than the opposing force of the return spring, the armature 30 does not move out of its idle position. If the magnetic force exceeds the spring force as the excitation current rises, the armature 30 moves toward the ferromagnetic return of the ferromagnetic circuit 20 until, finally, the air gap 21 has reached its minimum, with the armature 30 running up against a stop (not shown in FIG. 1), for example.

The time for this movement determines the switching time of the actuator unit. It depends decisively on the rate at which the magnetic force can be built up. One problem is that the excitation current builds up more slowly at a lower voltage and that, as a result, the armature moves more slowly. In the extreme case, this can lead to the armature 30 no longer reaching the stop or no longer leaving the idle position, e.g. in the case of an undervoltage, as can occur in the onboard electrical network of a motor vehicle.

In order to prevent this situation, the selected inductance of the magnetic circuit, i.e. of the excitation winding, can be as small as possible, for example. However, this leads to an increase in the current through the excitation winding. As an alternative or in addition, the supply voltage can be increased, leading to a more rapid rise in current for a given inductance of the excitation winding. Where the actuator unit is used in a motor vehicle, the onboard electrical voltage is normally 12 V. An increase in voltage would therefore require an expensive voltage transformer.

SUMMARY

One embodiment provides an actuator unit, in particular for injecting a fuel into a combustion chamber of an internal combustion engine, comprising an electrically conductive excitation winding, a ferromagnetic circuit having a ferromagnetic return and an armature, which can be moved along an axis, wherein the armature is held in an idle position by a holding force of a spring element, whereby the armature is spaced apart from the ferromagnetic return by an air gap, and wherein the armature is in a working position in which the armature adjoins the ferromagnetic return when a maximum coil current is flowing through the excitation winding and the winding is producing a magnetic motive force, wherein the ferromagnetic circuit and/or the armature are configured in such a way that, in the idle position, the armature makes contact with the ferromagnetic circuit by means of a surface segment in the direction of motion, wherein, in particular, the surface segment extends in a plane perpendicular to the axis of the movement of the armature, whereby, up to a predetermined current through the excitation winding, a magnetic field through the surface segment is produced, which produces a magnetic holding force acting in the axial direction which additionally acts in the direction of the spring force of the spring element, and wherein, when the predetermined current value is exceeded, the magnetic field is passed via an alternative path with increasing distance between the surface segment and the ferromagnetic circuit, as a result of which the magnetic holding force decreases with a steep gradient.

In a further embodiment, the surface segment is defined by a projection of the armature and/or of the ferromagnetic circuit.

In a further embodiment, the surface segment is arranged in the region of the axis of the armature.

In a further embodiment, the projection has a cup-shaped configuration.

In a further embodiment, the surface segment is arranged spaced apart from the axis of the armature in the radial direction.

In a further embodiment, the projection has an annular configuration.

In a further embodiment, the projection runs around a body of the armature, at least sectionwise.

In a further embodiment, the area of the surface segment is chosen in accordance with a desired magnetic holding force.

In a further embodiment, the projection is produced from a material such that the projection is magnetically saturated at a particular field strength.

In a further embodiment, the projection is an integral part of the armature and/or of the ferromagnetic circuit.

In a further embodiment, the projection is connected as a separate component to the armature and/or to the ferromagnetic circuit.

BRIEF DESCRIPTION OF THE DRAWINGS

Example embodiments are explained in greater detail below with reference to the drawings, in which.

DETAILED DESCRIPTION

Figure 1:
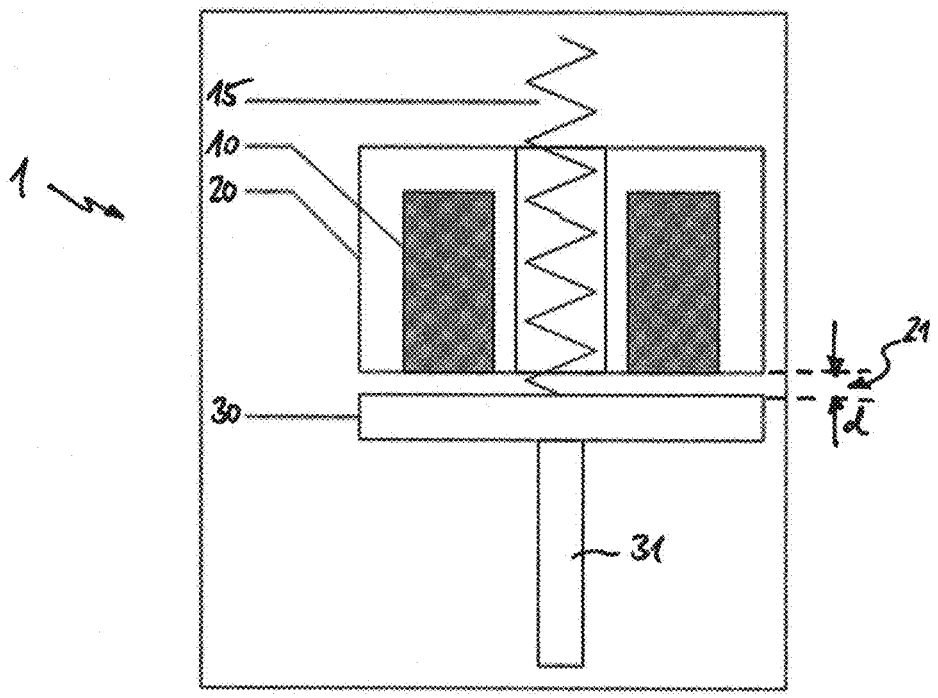
Prior Art Fig. 1
FIG. 1 shows a schematic illustration of a magnetic actuator known from the prior art.

Embodiments of the present disclosure provide a structurally and/or functionally improved actuator unit.

One embodiment provides an actuator unit, e.g., for injecting a fuel into a combustion chamber of an internal combustion engine. This unit comprises an electrically conductive excitation winding, a ferromagnetic circuit having a ferromagnetic return, and an armature, which can be moved along an axis. The armature is held in an idle position by a holding force of a spring element, whereby the armature is spaced apart from the ferromagnetic return by an air gap. The armature is in a working position in which the armature adjoins the ferromagnetic return when a maximum coil current is flowing through the excitation winding and the winding is producing a magnetic motive force. The ferromagnetic circuit and/or the armature are configured in such a way that, in the idle position, the armature makes contact with the ferromagnetic circuit by means of a surface segment in the idle position, wherein, in particular, the surface segment extends in a plane perpendicular to the axis of the movement of the armature. As a result, up to a predetermined current through the excitation winding, a magnetic field through the surface segment is produced, which produces a magnetic holding force acting in the axial direction which additionally acts in the direction of the spring force of the spring element. When the predetermined current value is exceeded, the magnetic field is passed via an alternative path with increasing distance between the surface segment and the ferromagnetic circuit, as a result of which the magnetic holding force decreases with a steep gradient.

One aspect of the invention is based on the consideration that the start of movement of the armature occurs when an equilibrium of forces between the spring force produced by the spring element and the magnetic motive force is achieved when a particular excitation current (referred to in the description which follows as a basic current) is flowing through the excitation winding. A force for accelerating the armature, currently prevailing in the actuator unit, in order to minimize the air gap is obtained from the respective difference between these two forces. Accelerated movement of the armature can thus take place only by means of an accelerated buildup of the magnetic force. This, in turn, depends on the rate of the current buildup by the excitation winding.

Through the design configuration of the actuator unit, the armature can now be held fast in its idle position up to a current value which is greater than the basic current defined above. This holding is accomplished by an additionally produced magnetic holding force, which results from the structural design of the actuator unit. The collapse of the additional holding force at the start of the movement has the effect of a jump in force.

By virtue of the fact that the armature can start with a higher motive force, there is in principle no need for a further buildup of force during the movement of the armature. This allows a significantly quicker switching operation in comparison with conventional actuator units. There is likewise no need for an increased supply voltage for a rapid switching operation and, as a result, the expensive voltage transformer can be eliminated.

Another advantage is that the actuator unit proposed can be implemented with low manufacturing costs.

Using the proposed actuator unit with fuel injection valves for motor vehicles results in a shortened switching time and hence in a reduction of the minimum injection quantity. The minimum injection quantity is determined by the time period between the opening and closing of the valve. This results in a major advantage for defined fuel metering.

One characteristic of the proposed actuator unit is that the time until the higher switching current is reached by the excitation winding is longer than in the case of actuator unit which has to function without the jump in force achieved here. This increased time is constant and can be calculated. This time can be allowed for by means of a corresponding lead in the activation of the excitation winding.

In principle, the surface segment which ensures the additional magnetic holding force can have any desired configuration.

According to one embodiment, the surface segment can be defined by a projection of the armature and/or of the ferromagnetic circuit. For example, the surface segment can be arranged in the region of the axis of the armature. It is expedient here if the projection has a cup-shaped configuration.

In another embodiment, the surface segment may be arranged spaced apart from the axis of the armature in the radial direction. Here, it is expedient if the projection has an annular configuration. In this case, the projection can run around a body of the armature, at least sectionwise. In particular, the projection can run completely around the body of the armature, with the result that it has the form of a closed ring.

Both variants take account of the fact that the actuator unit normally has a rotationally symmetrical configuration. By means of the embodiments described of the projection, particularly simple manufacture of the actuator unit is possible.

The area of the segment may be chosen in accordance with a desired magnetic holding force. The area selected is larger or smaller, depending on how large the holding force is supposed to be. As is known to a person skilled in the art, a larger area leads to a greater holding force. The appropriate area can be determined by tests or by calculation. Once the area necessary for a desired or required holding force has been determined, the configuration of the projection can be suitably selected.

According to another embodiment, the projection is produced from a material such that said projection is magnetically saturated at a particular field strength. This embodiment helps to ensure that the magnetic holding force can be limited to a predetermined value. Thus, the magnetic holding force cannot exceed a particular value, even if the current through the excitation winding for activation of the actuator unit is increased beyond the current value at which magnetic saturation occurs. This ensures that it is possible to move the armature into its working position.

In another embodiment, the projection is an integral part of the armature and/or of the ferromagnetic circuit. As an alternative, the projection can be connected as a separate component to the armature and/or to the ferromagnetic circuit. Such a connection can involve positive and/or material engagement.

Figure 2:
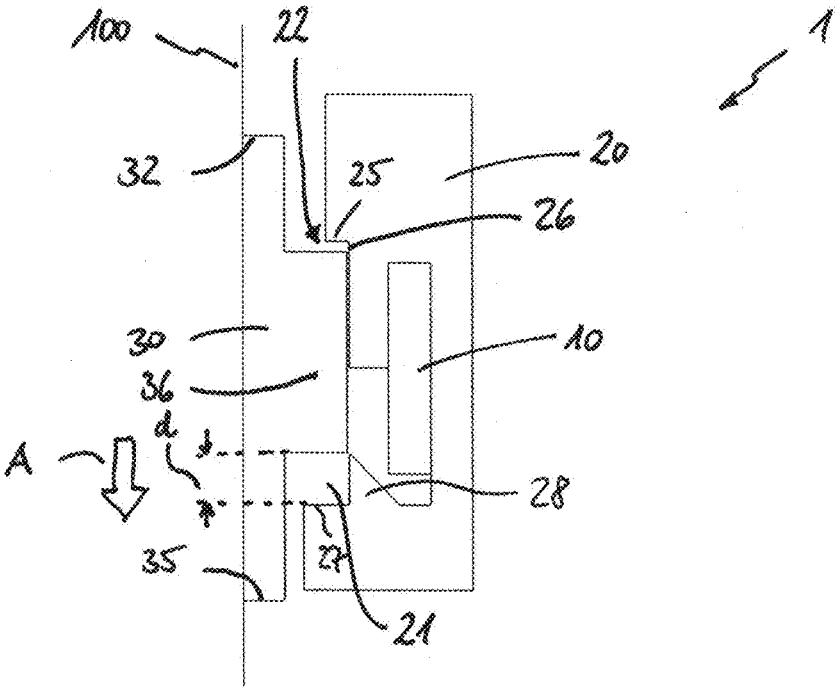
Prior Art FIG. 2
FIG. 2 shows a partial section through a conventional actuator unit in the form of a solenoid.

FIG. 2 shows a partial section through a conventional rotationally symmetrical actuator unit 1 in the form of a solenoid. The axis of rotation is denoted by the reference sign 100. The actuator unit 1 is suitable for large actuating distances. A large actuating distance is taken to mean a possible actuating distance of the armature of up to several millimeters. In FIG. 2, only the right-hand half of the solenoid is shown.

The actuator unit 1 comprises an electrically conductive excitation winding 10, a ferromagnetic circuit 20 having a ferromagnetic return and an armature 30 which can be moved along the axis 100 of rotation. The armature 30 has a first end 32 and a second end 35. The armature 30 of rotationally symmetrical design has a cylindrical body, which, by way of example, comprises an armature protrusion 36 in the center.

The armature protrusion 36 is likewise designed as a cylinder and has a larger diameter than the body.

The ferromagnetic circuit 20, which is composed of a magnetically conductive material, has a recess 26, in which the armature protrusion 36 can slide backward and forward along the axis 100. In this case, the armature protrusion is spaced apart from a shoulder 25 of the recess 26 in its idle position, in which no magnetic field is being produced by the excitation winding (cf. air gap 21). The idle position is brought about by a spring element (not shown in FIG. 2), which engages on the second end 35 of the armature 30, for example. The spring force brought about by the spring element pushes the armature 30 upward as shown on the page (counter to the arrow direction indicated by A), against the stop mentioned. The spacing is brought about, for example, by providing a stop (not shown specifically in FIG. 2) in the region of the second end 32 of the armature 30 to limit the further upward movement as shown on the page. The air gap 21 prevents the formation of a (retaining) holding force greater than the force of attraction. This would prevent movement of the armature.

As soon as there is a flow of current through the excitation winding 10, the overcoming of the spring force is followed by a movement of the armature 30 in arrow direction A until the armature protrusion 36 comes into contact with the shoulder 27 (or some other stop) of the ferromagnetic circuit 20. This position is referred to as the working position. As soon as the current through the excitation winding 10 falls back to zero, the armature 30 is pushed into the idle position, as shown in FIG. 2, counter to direction A by the spring force of the spring element (not shown).

Through targeted guidance of the magnetic field, a triangular return part indicated by the reference sign 28 allows the long armature actuating distance mentioned at the outset. The working air gap, which has a width d in the idle position, is indicated by the reference sign 21.

As already described at the outset, the start of movement of the armature 30 in an actuator unit 1 of this kind takes place when the equilibrium of forces between the spring force and the magnetic force is reached, as soon as a particular excitation current (basic current) is flowing through the excitation winding 10. Here, the prevailing force for acceleration of the armature 30 is the result of the respective difference between these two forces. The disadvantage of the actuator unit designed in this way consists in that an accelerated movement of the armature 30 can only be accomplished by means of an accelerated buildup of the magnetic force, and this depends on the rate of current buildup through the excitation winding 10.

In the two illustrative embodiments described below, in which the actuator unit has a modified structure as compared with FIG. 2, the armature can be held fast in its idle position by means of an additional magnetic holding force up to a particular increased current value, which is greater than the basic current. When this increased current value is exceeded, the armature 30 is set in motion and the additional magnetic holding force decreases as soon as there is only a small distance between the armature 30 and the ferromagnetic circuit 20. As a result, the spring force is opposed by a significantly increased magnetic force, which is already effective immediately after the start of the movement of the armature 30 and does not have to be built up only during the movement of the armature 30.

Figure 3:
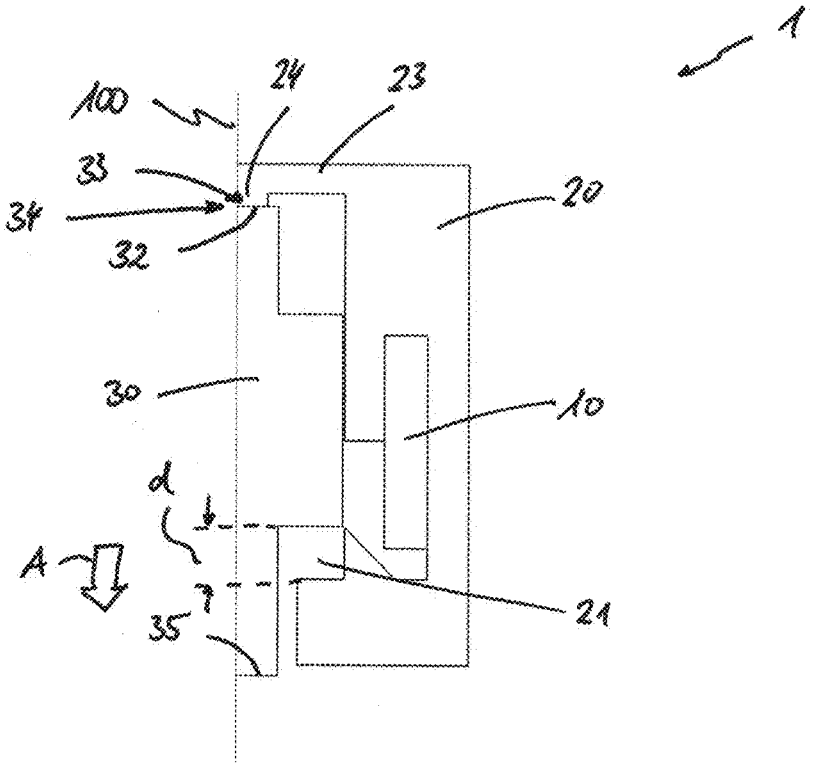
FIG. 3 shows a partial section through an actuator unit according to the invention in the form of a solenoid in accordance with a first variant embodiment.

In the first illustrative embodiment, which is shown in FIG. 3, the ferromagnetic circuit 20 is modified in such a way that the armature 30 rests against the ferromagnetic circuit 20 by means of a surface segment 33 in its idle position. Here, the surface segment 33 extends in a plane perpendicular to the axis 100, as can easily be seen from FIG. 3. In the region of the surface segment 33, the first end of the armature 32 and an axially arranged projection 24 of a radially extending leg 23 of the ferromagnetic circuit 20 are directly adjacent. This means that the spacing 34 between the projection 24 and the first end 32 of the armature 30 in the idle position is x=0.

Figure 4:
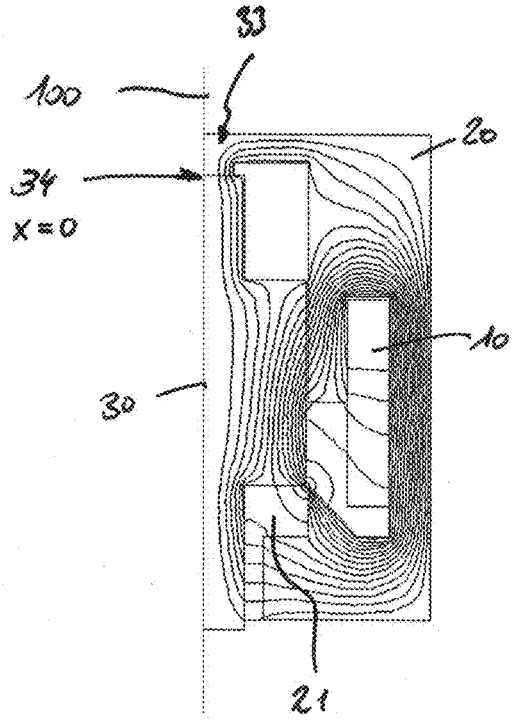
FIG. 4 shows the profile of magnetic field lines through the actuator unit shown in FIG. 3, wherein the armature is in its idle position.

FIG. 4 shows the profile of magnetic field lines through the actuator unit 1 shown in FIG. 3 when there is a flow of current through the excitation winding 10. In FIG. 4, the armature is still in its idle position. As can be seen in FIG. 4, some of the magnetic field lines pass through the surface segment 33. This produces the abovementioned magnetic holding force acting additionally in the direction of the spring force.

As the current through the excitation winding 10 increases, a magnetic force (magnetic motive force) acting in direction A and an opposing magnetic holding force are built up. When the ferromagnetic return has reached its saturation magnetization in the region of the surface segment 33, the magnetic holding force will no longer rise, while, in contrast, the magnetic motive force does tend to do so. As soon as this magnetic motive force is greater than the sum of the spring force and the magnetic holding force, the spacing 34 becomes larger, i.e. x becomes greater than 0. Owing to the air gap which arises in the region of the surface segment 33, the magnetic field lines no longer pass via the surface segment 33 but are directed via an alternative path. This has the effect that the magnetic holding force decreases with a steep gradient.

Figure 5:
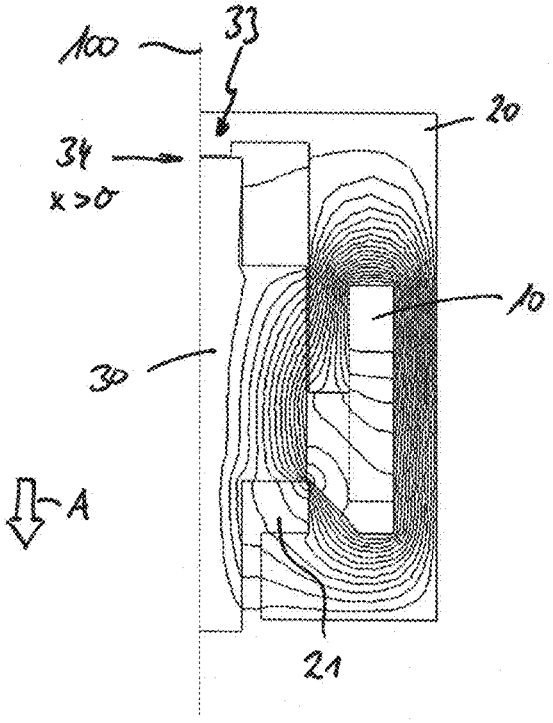
FIG. 5 shows the profile of magnetic field lines through the actuator unit shown in FIG. 3, wherein the armature has moved partially in the direction of its working position.

This situation is illustrated by way of example in FIG. 5, which illustrates the profile of the magnetic field lines through the actuator unit 1 shown in FIG. 3 after an air gap has formed in the region of the surface segment 33. As a result, the spring force is opposed by a significantly increased magnetic motive force, which acts immediately after the start of the movement of the armature 30, and does not have to be built up only during the movement of the armature. This gives rise to the desire jump in force, allowing a shortened switching time of the actuator unit 1.

Figure 6:
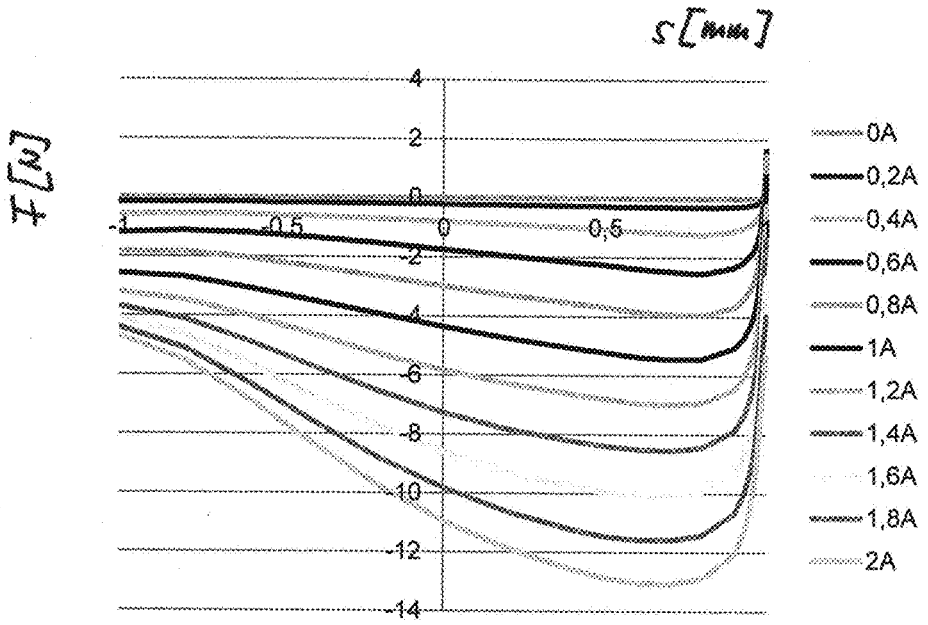
FIG. 6 shows a force/displacement diagram for various currents through an excitation winding of the actuator unit in FIG. 3.
Figure 7:
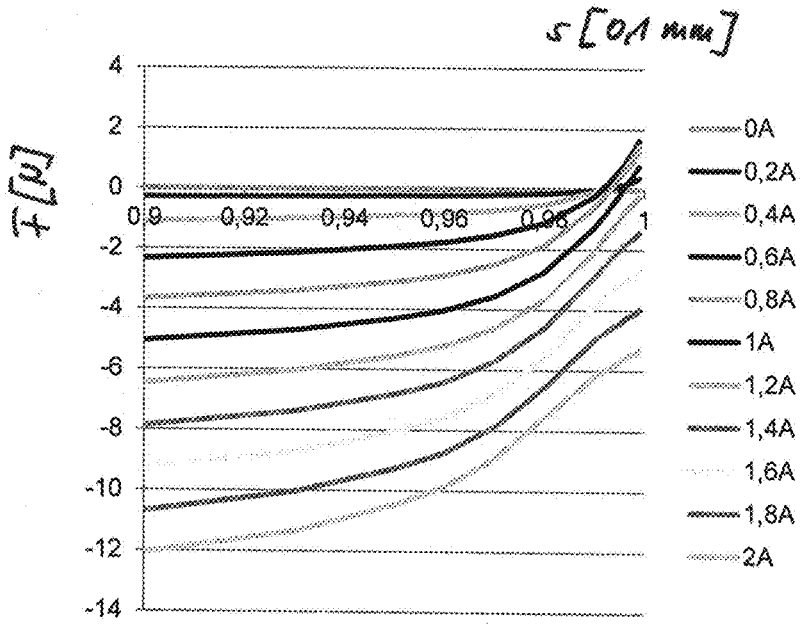
FIG. 7 shows an enlarged segment of the force/displacement diagram in FIG. 6.

The force/displacement diagrams in FIGS. 6 and 7 show the simulated force/displacement profile of the magnetic motive force. FIG. 6 shows the entire distance traveled (1.0 mm to −1.0 mm). The idle position of the actuator unit shown in FIG. 3 is at +1.0 mm. FIG. 7 shows a segment of the distance (from +1.0 mm to +0.9 mm). In particular, the initial additional magnetic holding force ("positive force value"), which completely disappears after a minimal distance (0.02 mm), is very clearly visible here. Thus, the entire magnetic force built up until that point is available for the acceleration of the armature 30.

Figure 8:
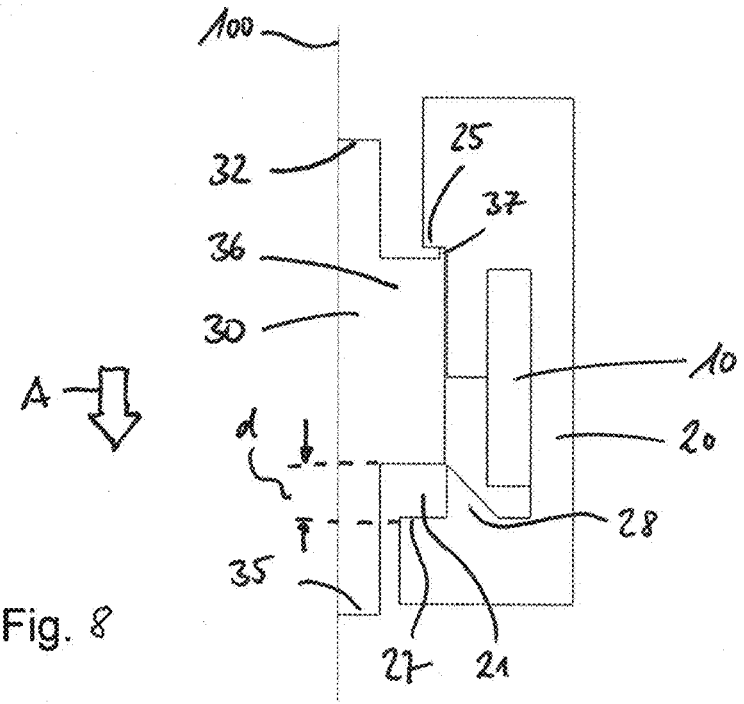
FIG. 8 shows a partial section through an actuator unit according to the invention in the form of a solenoid in accordance with a second variant embodiment.
Figure 9:
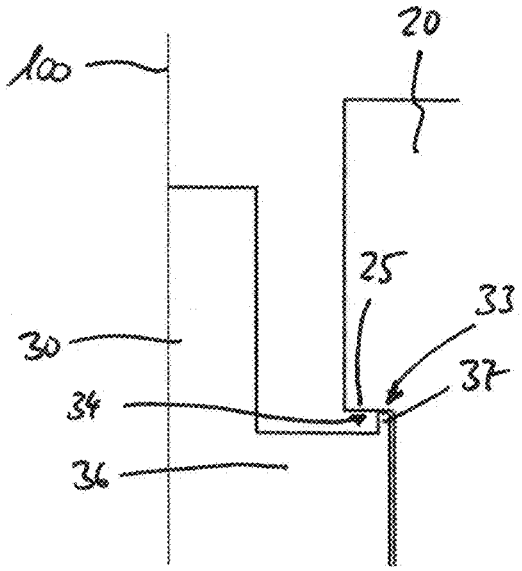
FIG. 9 shows an enlarged segment of the armature of the actuator unit in FIG. 8, applied to a ferromagnetic circuit in the idle position.

In the second illustrative embodiment, which is shown in FIG. 8, the magnetic holding force is produced by an annular projection 37 in the region of the armature protrusion 36. The projection runs around the body of the armature completely or at least sectionwise. The configuration of the projection, which is web-shaped in cross section, is shown on an enlarged scale in FIG. 9. Here, the area with which the projection 37 adjoins the shoulder 25 of the recess 26 of the ferromagnetic circuit 20 determines the magnetic holding force. In principle, the bearing surface could be larger or smaller than that selected in the illustrative embodiment shown (e.g. through modification of the width of the web). In contrast to the first illustrative embodiment shown in FIG. 3, the ferromagnetic circuit 20 does not need to have a shoulder 23 with a central projection 24 in the region of the axis 100 of rotation.

Figure 10:
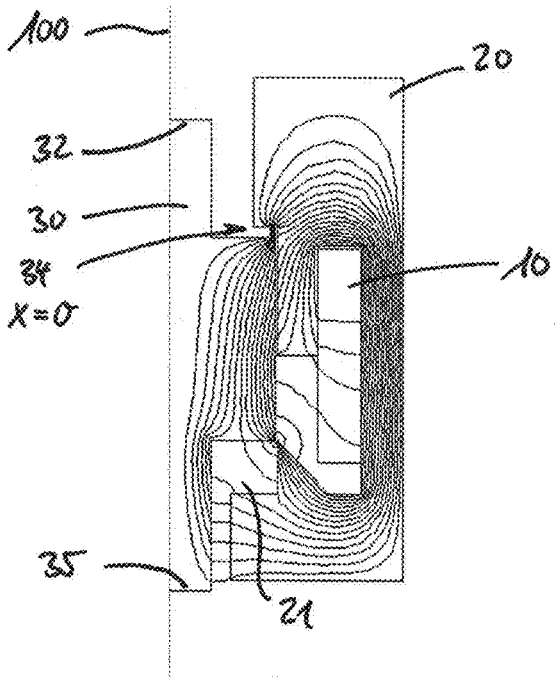
FIG. 10 shows the profile of magnetic field lines through the actuator unit shown in FIG. 8, wherein the armature is in its idle position.
Figure 11:
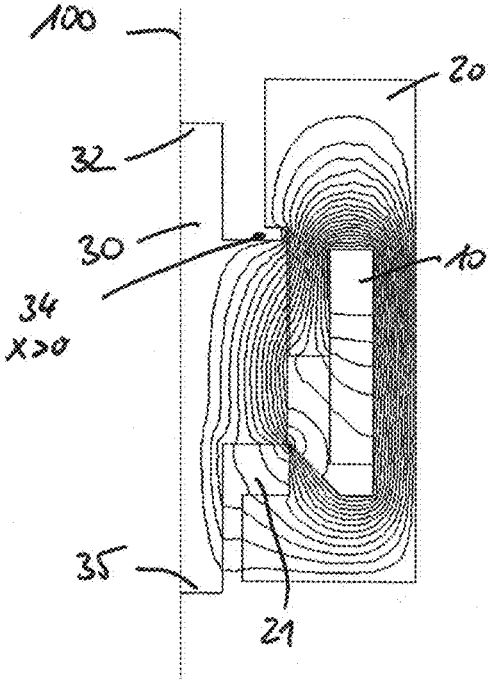
FIG. 11 shows the profile of magnetic field lines through the actuator unit shown in FIG. 8, wherein the armature has moved by $x>0$ in the direction of its working position.
Figure 12:
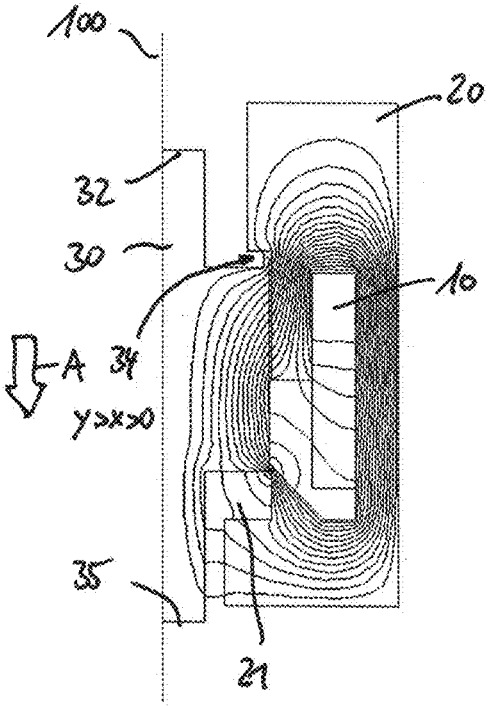
FIG. 12 shows the profile of magnetic field lines through the actuator unit shown in FIG. 8, wherein the armature has moved by $y>x>0$ in the direction of its working position.

When the magnetic field is built up, the magnetic field passing through the annular projection 37 and the ferromagnetic circuit 20 builds up an axial magnetic holding force which opposes the magnetic motive force (in arrow direction A). The magnetic motive force is produced by the field extending from the armature 30 to the lower, triangular return part 28. The projection 37 is designed in such a way that the material thereof is magnetically saturated at a particular field strength, this field strength being reached at a lower current value than the maximum coil current. If the current rises further, the magnetic field increasingly passes from the axially extending part of the ferromagnetic circuit 20 to the armature 30. As a result, the axial magnetic holding force does not rise any further. However, since the magnetic motive force acting in the direction of the arrow A continues to rise as the current flow increases, there is overall an increase in the motive force. If the magnetic motive force finally exceeds the magnetic holding force and also the spring force of the spring element (not shown), the armature 30 is set in motion. An air gap is now formed between the projection 37 and the ferromagnetic circuit 20, significantly increasing the magnetic resistance. As a result, the magnetic field changes course abruptly. It switches from axial through the projection 37 (cf. FIG. 10, in which the armature 30 is in its idle position) to radial through the radial air gap between the armature 30 and the ferromagnetic circuit 20, as can be seen in a time sequence in FIG. 11 (spacing x>0) and (spacing y>x>0). For this reason, the magnetic holding force quickly decreases.

Figure 13:
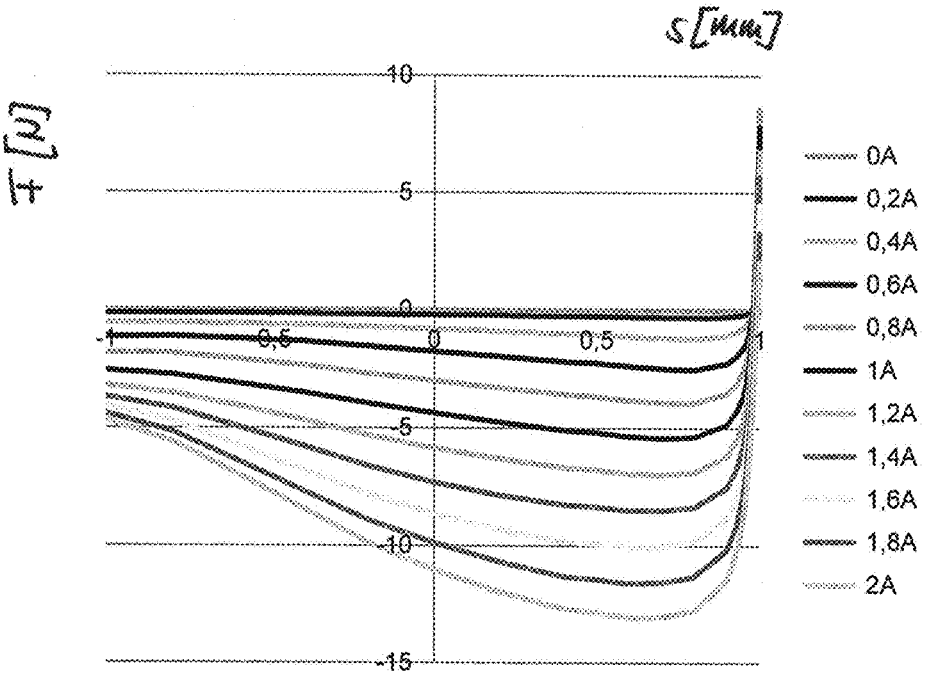
FIG. 13 shows a force/displacement diagram for various currents through an excitation winding of the actuator unit in FIG. 8.
Figure 14:
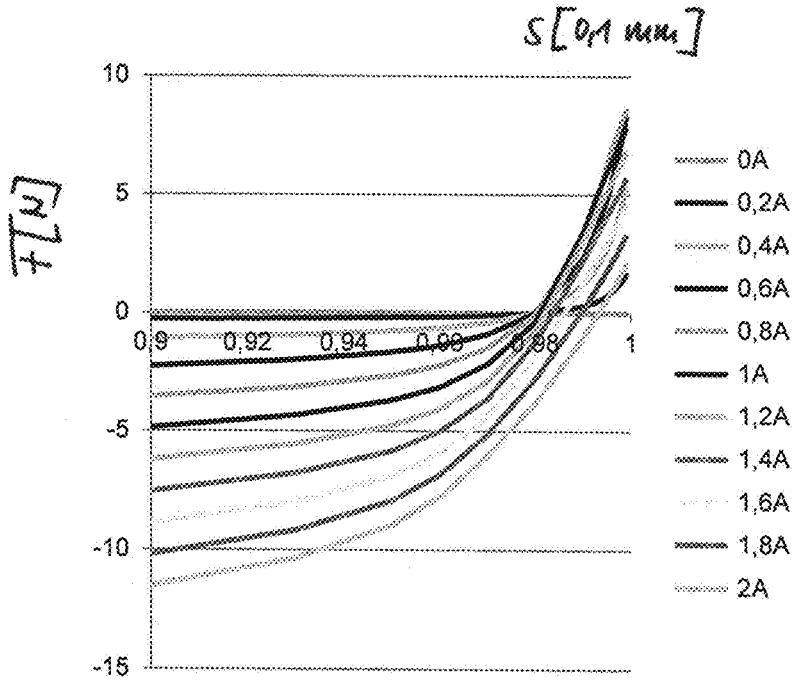
FIG. 14 shows an enlarged segment of the force/displacement diagram in FIG. 13.

FIGS. 13 and 14 each show a force/displacement diagram which simulates the force/displacement profile of the magnetic motive force. Here, FIG. 13 shows the entire distance traveled (1.0 mm to −1.0 mm). Once again, the idle position of the actuator unit 1 shown in FIG. 8 is at +1.0 mm. FIG. 14 once again shows a segment of the distance (from +1.0 mm to +0.9 mm). Here too, the initial additional magnetic holding force, the "positive force value", which completely disappears after a minimal distance, is clearly visible. Thus, the entire magnetic force built up until that point is available for the acceleration of the armature 30.

It is self-evident that the illustrative embodiments shown in FIGS. 3 and 8 can easily be modified within the scope of the invention. This applies, in particular, to the shape and arrangement of the projections on the armature and/or on the ferromagnetic circuit.

The embodiment described of the actuator unit allows the armature 30 to start at a higher motive force in comparison with conventional actuator units. Thus, no further buildup of force is required during the movement of the armature. As a result, this allows significantly more rapid switching. It is likewise possible to dispense with an increased supply voltage for a switching operation.

The actuator unit proposed is suitable, in particular, for use as a fuel injection valve, by means of which a shorter switching time and hence a reduction in the minimum injection quantity is possible.

What is claimed is:

1. An actuator unit for injecting a fuel into a combustion chamber of an internal combustion engine, comprising:

an electrically conductive excitation winding disposed in a housing, a first ferromagnetic circuit loop including a return through a projection of the housing, a second ferromagnetic circuit loop through the housing without passing through the return an armature configured to move along an axis between:

an idle position in which the armature completes the second ferromagnetic circuit loop by contact with a surface segment that extends in a plane perpendicular to the axis of movement of the armature, a working position in which the armature completes the first ferromagnetic circuit loop by contact with the return, wherein the armature is biased along the axis toward the idle position by a spring holding force of a spring element, wherein a current flowing through the excitation winding produces a magnetic field that provides (a) a magnetic holding force acting on the armature in the same direction as the spring holding force provided by the spring element, and (b) a magnetic motive force acting on the armature in the opposite direction as the magnetic holding force and spring holding force, wherein when the current flowing through the excitation winding is less than or equal to a predetermined current value, the current produces a magnetic holding force which, in combination with the spring holding force, is greater than the magnetic motive force, thereby holding the armature in the idle position as magnetic flux passes through the first ferromagnetic circuit loop, and wherein when the current flowing through the excitation winding exceeds the predetermined current value, the magnetic motive force produced by the current exceeds the magnetic holding force combined with the spring holding force, which produces an air gap in the region of the surface segment, breaking the first ferromagnetic circuit loop and, resulting in the magnetic holding force decreasing with a steep gradient and the armature moving toward the working position.

2. The actuator unit of claim 1, wherein the surface segment is defined by at least one of a projection of the armature and a projection of the ferromagnetic circuit.

3. The actuator unit of claim 1, wherein the axis of movement of the armature extends through the surface segment.

4. The actuator unit of claim 1, wherein the surface segment is defined by at least one of a cup-shaped projection of the armature and a cup-shaped projection of the ferromagnetic circuit.

5. The actuator unit of claim 1, wherein the surface segment is spaced apart from the axis of movement of the armature in a radial direction.

6. The actuator unit of claim 5, wherein the surface segment is defined by at least one of an annular projection of the armature and an annular projection of the ferromagnetic circuit.

7. The actuator unit of claim 6, wherein the projection runs around a body of the armature, at least sectionwise.

8. The actuator unit of claim 1, wherein the area of the surface segment is selected to provide a predetermined magnetic holding force.

9. The actuator unit of claim 2, wherein the projection is produced from a material that becomes magnetically saturated at a particular field strength.

10. The actuator unit of claim 1, wherein the surface segment is defined by at least one of a projection integral with the armature and a projection integral with the ferromagnetic circuit.

11. The actuator unit of claim 1, wherein the surface segment is defined by at least one of a projection connected to the armature as a separate component and a projection connected to the ferromagnetic circuit as a separate component.

12. A method of operating an actuator unit comprising an electrically conductive excitation winding disposed in a housing, a first ferromagnetic circuit loop including a return through a projection of the housing, a second ferromagnetic circuit loop through the housing without passing through the return, and an armature configured to move along an axis between (a) an idle position in which the armature completes the second ferromagnetic circuit loop by contact with a surface segment that extends in a plane perpendicular to the axis of movement of the armature, and (b) a working position in which the armature completes the first ferromagnetic circuit loop by contact with the return, wherein the armature is biased along the axis toward the idle position by a spring holding force of a spring element, the method comprising:

applying a current through the excitation winding that produce a magnetic field that provides (a) a magnetic holding force acting on the armature in the same direction as the spring holding force provided by the spring element, and (b) a magnetic motive force acting on the armature in the opposite direction as the magnetic holding force and spring holding force, setting the current flowing through the excitation winding to a value less than or equal to a predetermined current value, which produces a magnetic holding force which, in combination with the spring holding force, is greater than the magnetic motive force, thereby holding the armature in the idle position as magnetic flux flows through the first ferromagnetic circuit loop, and increasing the current flowing through the excitation winding above the predetermined current value, which causes the magnetic motive force produced by the current to exceed the magnetic holding force combined with the spring holding force, which produces an air gap in the region of the surface segment, breaking the first ferromagnetic circuit loop and resulting in the magnetic holding force decreasing with a steep gradient and the armature moving toward the working position.

* * * * *